US008038320B2

(12) United States Patent
Sloan et al.

(10) Patent No.: US 8,038,320 B2
(45) Date of Patent: Oct. 18, 2011

(54) PACKAGING FOR LIGHTING MODULES

(75) Inventors: Thomas C. Sloan, Santa Barbara, CA (US); Timothy Ferrie, Ojai, CA (US)

(73) Assignee: The Sloan Company, Inc., Ventura, CA (US)

( * ) Notice: Subject to any disclaimer, the term of this patent is extended or adjusted under 35 U.S.C. 154(b) by 924 days.

(21) Appl. No.: 11/823,531

(22) Filed: Jun. 27, 2007

(65) Prior Publication Data

US 2009/0021937 A1 Jan. 22, 2009

Related U.S. Application Data

(60) Provisional application No. 60/817,982, filed on Jun. 30, 2006.

(51) Int. Cl.
*F21V 27/00* (2006.01)

(52) U.S. Cl. ..... 362/249.01; 362/249.02; 362/249.04; 362/249.08

(58) Field of Classification Search ..... 362/249.01, 362/249.02, 249.04, 249.08, 362, 391, 812; 206/531, 539, 521, 15, 2, 7, 589, 593
See application file for complete search history.

(56) References Cited

U.S. PATENT DOCUMENTS

| | | | | |
|---|---|---|---|---|
| 737,129 | A * | 8/1903 | Murray | 40/541 |
| 4,439,818 | A * | 3/1984 | Scheib | 362/249.06 |
| 6,846,093 | B2 | 1/2005 | Swaris et al. | 362/249 |
| 6,932,495 | B2 | 8/2005 | Sloan et al. | 362/294 |
| 7,201,511 | B2 * | 4/2007 | Moriyama et al. | 362/646 |
| 7,441,933 | B2 * | 10/2008 | Tsukamoto et al. | 362/548 |

* cited by examiner

*Primary Examiner* — Sharon Payne
(74) *Attorney, Agent, or Firm* — Koppel, Patrick, Heybl & Philpott

(57) ABSTRACT

A package for holding a plurality of LED modules interconnected by wire. The package comprises a plurality of cradles each of which is sized to hold a respective one of the interconnected LED modules. Each of the cradles comprises first and second opposing side vertical surfaces partially defining a space for holding its respective one of the LED modules, each of the LED modules arranged in a respective one of the cradles. A plurality of holding tabs is included at least one of which is on one of the first and second opposing side vertical surfaces of each of the cradles and protruding into the module holding space. Each of the tabs is arranged to hold its respective one of the modules in its cradle, wherein the cradles are arranged adjacent to one another with the interconnecting wire running between adjacent cradles.

22 Claims, 8 Drawing Sheets

PACKAGING FOR LIGHTING MODULES

This application claims the benefit of U.S. Provisional Patent Application Ser. No. 60/817,982 to Sloan filed on Jun. 30, 2006.

BACKGROUND OF THE INVENTION

1. Field of the Invention

This invention relates to packaging and more particularly to a packaging device for lighting modules such as those used for illuminating channel letters.

2. Background of the Invention

Light emitting diodes (LED or LEDs) are solid state devices that convert electric energy to light, and generally comprise one or more active layers of semiconductor material sandwiched between oppositely doped layers. When a bias is applied across the doped layers, holes and electrons are injected into the active layer where they recombine to generate light. Light is emitted from the active layer and from all surfaces of the LED.

Developments in LED technology have resulted in devices that are brighter, more efficient and more reliable. LEDs are now being used in many applications that were previously the realm of incandescent fluorescent or neon bulbs; some of these include displays, automobile taillights and traffic signals. LEDs are also now being used to illuminate channel letter signs. These lighting systems typically comprise a plurality of LED modules each of which has at least one LED. These modules are interconnected by wires that transmit an electrical signal between the modules such that an electrical signal applied to the input end of the modules is transmitted to all the interconnected modules. One example of these interconnected LED modules is described in U.S. Pat. No. 6,932,495 to Sloan et al. (assigned to the assignee as the present application) entitled "Channel letter lighting using light emitting diodes." The desired length of interconnected LED modules can typically be cut from the remainder, with the LED modules in both the cut portion and remainder capable of emitting light by applying an electrical signal.

Interconnected LED modules are typically provided to the consumer in various packages which can be disorganized and inconvenient. Two examples of these include bags and boxes with the LED modules and wires loosely arranged therein. These packages can lead to tangling and related difficulties in removing the LED modules in an orderly way. It is also difficult to determine what length of LED module is provided in or remains in the packaging, and it is also difficult to determine the appropriate location to cut the interconnected modules when a shorter length is desired. It can also be difficult to see all of the modules during visual inspection and illumination testing.

U.S. Pat. No. 6,846,093 to Swaris et al. discloses another package for interconnected LED modules with the package comprising a dispensing roll having pre-wired LED modules wound upon a roller. In use the desired length of the modules are pulled from the dispenser to progressively install the pre-wired LED modules. When the appropriate number of LED modules are installed, the worker simply snips the wires disconnecting the installed LED modules from the LED modules that are still on the dispensing roll. With this arrangement, however, it is difficult to determine the length of modules on the role and a significant number of modules can be hidden below other modules on the roll making it difficult to visually and electrically test the modules. Further, the desired length of modules must first be unwound from the roll before being cut. There is no mechanism for determining the proper cutting location while the modules are still on the roll.

SUMMARY OF THE INVENTION

One embodiment of a package for holding a plurality of interconnected modules according to the present invention comprises a plurality of cradles each of which is sized to hold a respective one of a plurality of interconnected modules. The cradles are arranged adjacent to one another with each cradle comprising first and second opposing side vertical surfaces at least partially defining a module holding space. A plurality of holding tabs are included at least one of which is on a respective one of the cradles on one of the first and second opposing side vertical surfaces and protruding into the module holding space. The tab is arranged to hold its respective one of the modules in the cradle.

One embodiment of a package according to the present invention holding a plurality of LED modules comprises a plurality of LED modules interconnected by wire. The package comprises a plurality of cradles each of which is sized to hold a respective one of the plurality of interconnected LED modules. Each of the cradles comprising first and second opposing side vertical surfaces partially defining a space for holding its respective one of the LED modules, each of the LED modules arranged in a respective one of the cradles. A plurality of holding tabs is included at least one of which is on one of the first and second opposing side vertical surfaces of each of the cradles and protruding into the module holding space. Each of the tabs is arranged to hold its respective one of the modules in its cradle, wherein the cradles are arranged adjacent to one another with the interconnecting wire running between adjacent cradles.

Another embodiment of a package for holding a plurality of interconnected modules, comprising a plurality of walls, the surfaces of the walls comprising first and second opposing side vertical surfaces. Respective ones of the opposing side vertical surfaces at least partially defining one of a plurality of module holding cradles. Each of the cradles is sized to hold a respective one of a plurality of interconnected modules with the cradles arranged adjacent to one another. Each of the cradles first and second opposing side vertical surfaces partially defining the module holding space. The walls are made of a resilient material such that the first and second opposing side vertical surfaces of each of the cradles provide an opposing holding force.

These and other aspects and advantages of the invention will become apparent from the following detailed description and the accompanying drawings which illustrate by way of example the features of the invention.

DETAILED DESCRIPTION OF THE INVENTION

Figure 1:
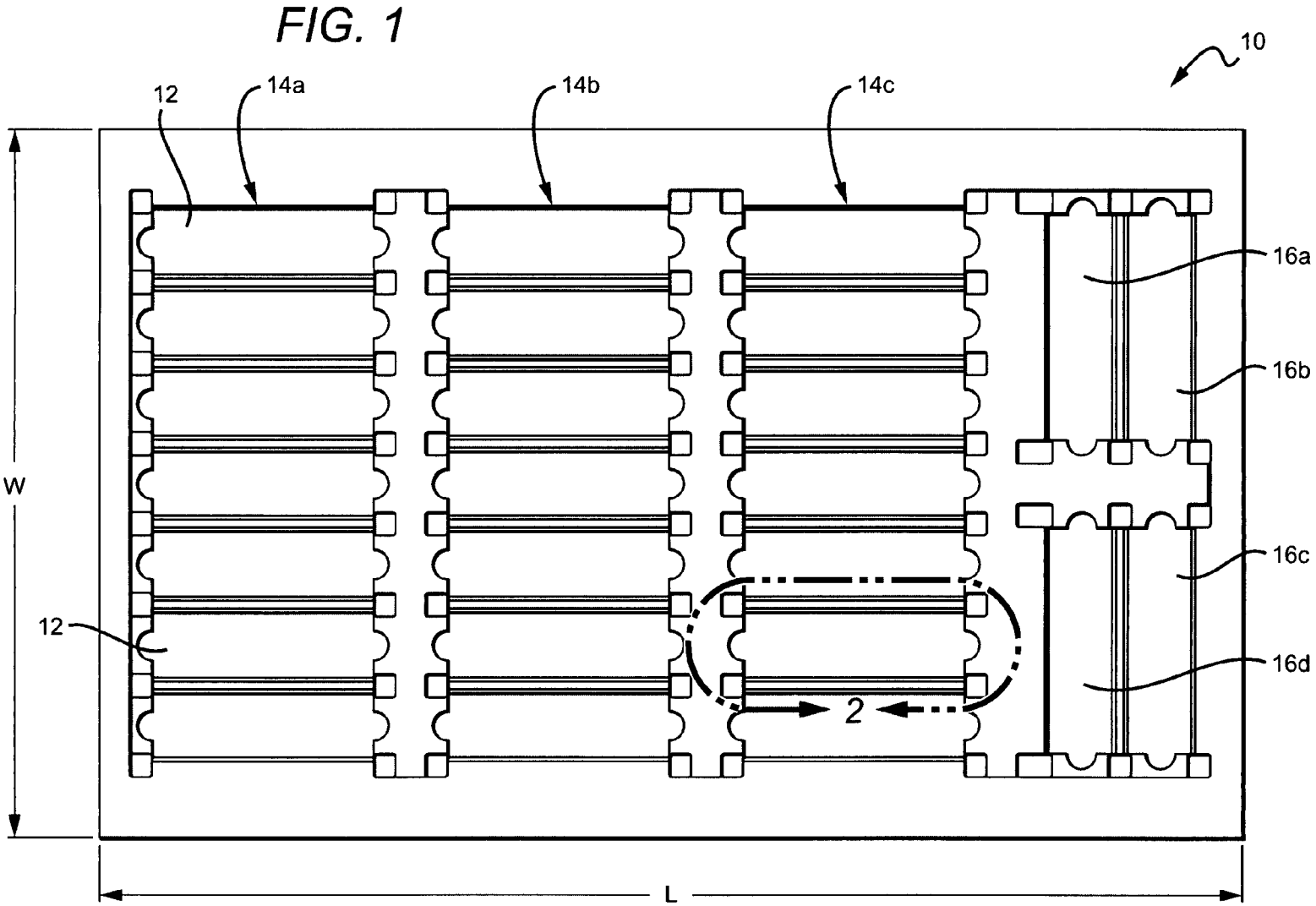
FIG. 1 is a plan view of one embodiment of lighting module package according to the present invention.

Briefly, and in general terms, the present invention relates to improved packaging for lighting modules, and in particular interconnected LED lighting modules. The packaging comprises a plurality of cradles, each of which is arranged to hold a respective one of the LED modules with the modules and interconnecting wires. The wires between the modules can be cut to remove only a section of the interconnected modules from the package with the remaining LED modules conveniently remaining in the package for future use.

The package is easy to manufacture, low in cost, easy to use and displays the LED modules precise and esthetically pleasing manner. The package can further comprise a cover to protect the LED modules and interconnecting wires, and the packages can be stacked for shipping. The packaging is also light weight and is particularly adapted to packaging light emitting diode (LED) lighting modules, such as those for illuminating channel letters. It is understood, however, that the packaging can be used for many different applications. The package generally consists of a tray having a plurality of cradles for holding LED modules with the LED facing up. The package can be fabricated using many different methods, with a preferred method being vacuum formed, which is known in the art.

Different packages according to the invention can also be provided to hold different sized lighting modules with the different packages having substantially the same footprint (length and width) and similar density. The packages can be stackable without damaging the LED modules, and because they have the same footprints, the different packages with different sized modules can be stacked and shipped in a standard sized box. In one embodiment, a packaging box can be sized to hold five (5) stacked packages.

The packages according to the present invention allow for relatively high density packaging of LED modules with the modules firmly and uniformly held in cradles within the packages. Each of the packages typically holds a standard length of LED modules with interconnecting wires, for different sized LED modules, with a suitable length being 25 feet. For longer LED modules, a fewer number of modules will be included in this 25 foot length and in the packaging compared to shorter LED modules. By having the same length for different sized modules, the end user can easily and accurately confirm the length of delivered modules and similarly provide and accurate length to match a particular lighting application.

The LED modules are preferably held in the package according to the present invention with each of the LED modules visible and accessible for inspection, counting and testing. The interconnecting wires between the LED modules are also accessible in the packages according to the present invention with the wires neatly routed between the LED modules. The interconnecting wires can be cut while the modules are held in the package cradles, with the cut section then being removable. The remaining LED modules can remain undisturbed in their package cradles for later use. The visibility of the LED modules and the predetermined length in the package also allows the user to easily and accurately cut out a desired length of product by simply determining the length between the LED modules and counting the modules.

In one embodiment of a package according to the present invention, each of the cradles in the packages are arranged to hold a respective one of the LED modules firmly in the package until removed by the user, with uniform wire routing between the modules. There is little wasted space between the LED modules, which helps maximize density. In a preferred embodiment, the cradles hold the LED modules such that the packaging can be held inverted and the LED modules will not fall out of their respective cradles. The packages are also arranged so that a lid can cover the modules, and in one embodiment the lid can be made of cardboard and can contain writing such as user instructions, part numbers, product features, or other information. The cardboard cover also adds rigidity to the package allowing the package to provide greater protection to the LED module.

The present invention is described herein with reference to certain embodiments but it is understood that the invention can be embodied in many different forms and should not be construed as limited to the embodiments set forth herein. In particular, the present invention is described below in regards to packaging LED modules used for illuminating channel letters, but it is understood that the present invention can be used for packaging many different devices in different ways.

It is also understood that when an element or feature is referred to as being "on" another element or feature, it can be directly on the other element or feature or intervening elements may also be present. Furthermore, relative terms such as "inner", "outer", "upper", "above", "lower", "beneath", and "below", and similar terms, may be used herein to describe a relationship of one element or feature to another. It is understood that these terms are intended to encompass different orientations of the packaging in addition to the orientation depicted in the figures.

Although the terms first, second, etc. may be used herein to describe various elements, components, features or and/or sections, they should not be limited by these terms. These terms are only used to distinguish one element, component, feature or section from another. Thus, a first element, component, feature or section discussed below could be termed a second element, component, feature or section without departing from the teachings of the present invention.

Embodiments of the invention are described herein with reference to cross-sectional view illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. A feature illustrated or described as square or rectangular can have rounded or curved features due to normal manufacturing tolerances. Thus, the features illustrated in the figures are not intended to illustrate the precise shape of a feature and are not intended to limit the scope of the invention.

FIG. 1 shows one embodiment of a package 10 according to the present invention having a plurality of cradles each of which is sized to hold an LED module (not shown) of a particular size. As described above, the package 10 has a standard size and the cradles 12 are arranged to hold a standard length of LED modules and interconnecting wires. In the embodiment shown the length is 25 feet. In the embodiment shown, the package 10 has a 12 inch width W and a 20 inch length L, with a height of approximately ¾ inch. The cradles can be arranged in different ways in packages according to the present invention, with the cradles 12 arranged in three rows 14*a-c*, with four additional cradles 16*a-d* arranged adjacent to row 14*c*. When LED modules are arranged in the cradles 12, interconnecting wires are routed between the modules, preferably between adjacent modules, with both the modules and interconnecting wires being visible and accessible as described above.

Figure 3:
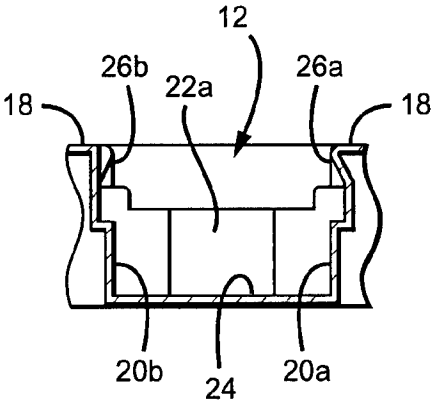
FIG. 3 is a sectional view of the cradle shown in FIG. 2.
Figure 2:
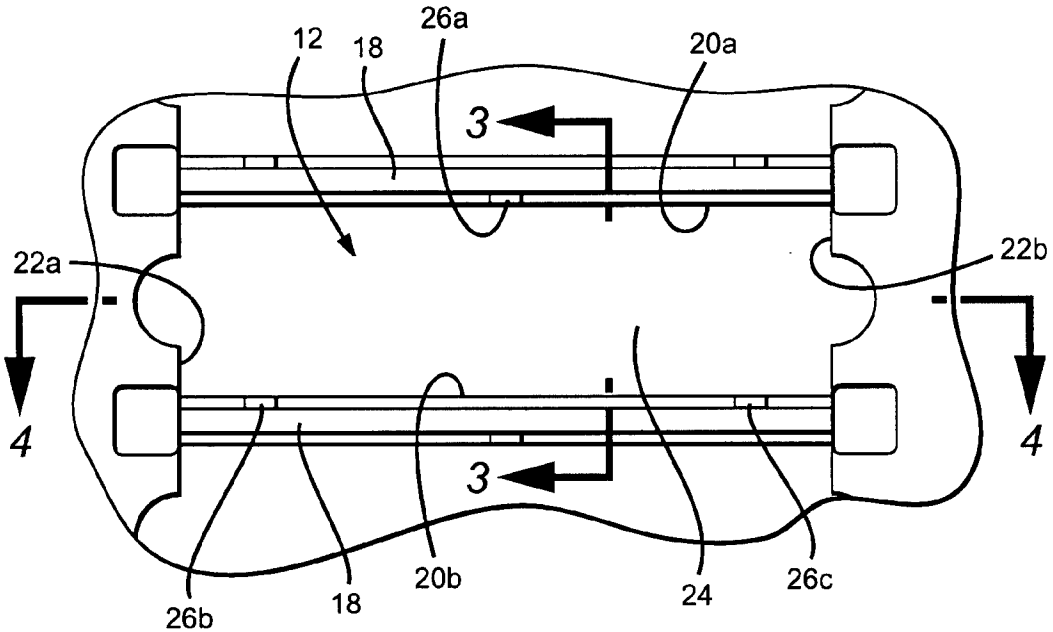
FIG. 2 is a plan view of one of the lighting module cradles in the package in FIG. 1.
Figure 4:
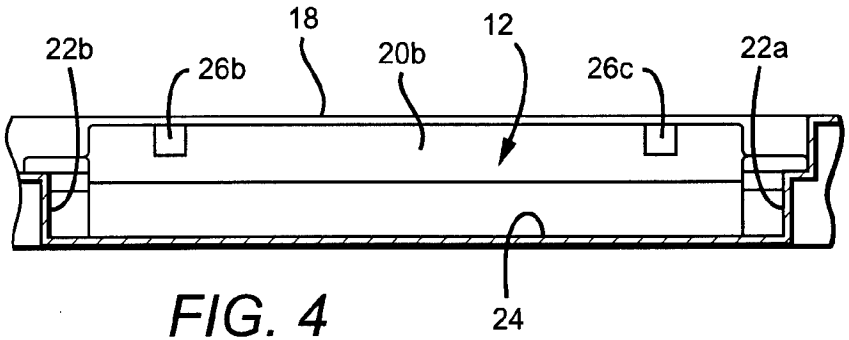
FIG. 4 is another sectional view of the lighting module cradle shown in FIG. 2.

FIGS. 2-4 show the cradle 12 in greater detail. Walls 18 are provided between adjacent cradles 12 with the walls 18 providing first and second opposing side vertical surfaces 20*a*, 20*b* for each cradle 12. The cradle also comprises lower opposing end surfaces 22*a*, 22*b* and a bottom surface 24. The cradles can also comprise tabs to help hold the LED module in the cradle, with the first vertical surface 22*a* having a first tab 26*a*, and the second vertical surface has second and third tabs 26*b*, 26*c* near its ends. Each of the tabs 26*a-c* protrudes into the space between the vertical surfaces 22*a*, 22*b*.

The cradle 12 is sized such that the desired module fits closely within its respective cradle. The material comprising the package 10 and its cradle tabs is resilient such that as an LED module is placed within one of the cradles 12, the tabs 26*a-c* and walls 18 can flex out allowing the module to pass the tabs 26*a-c*. When the module is fully within its cradle 12, the walls flex back with the tabs 26*a-c* being over the top surface of the module. This firmly holds the module within its cradle as described above. This flexing also allows for the modules to be easily removed by the user.

Figure 5:
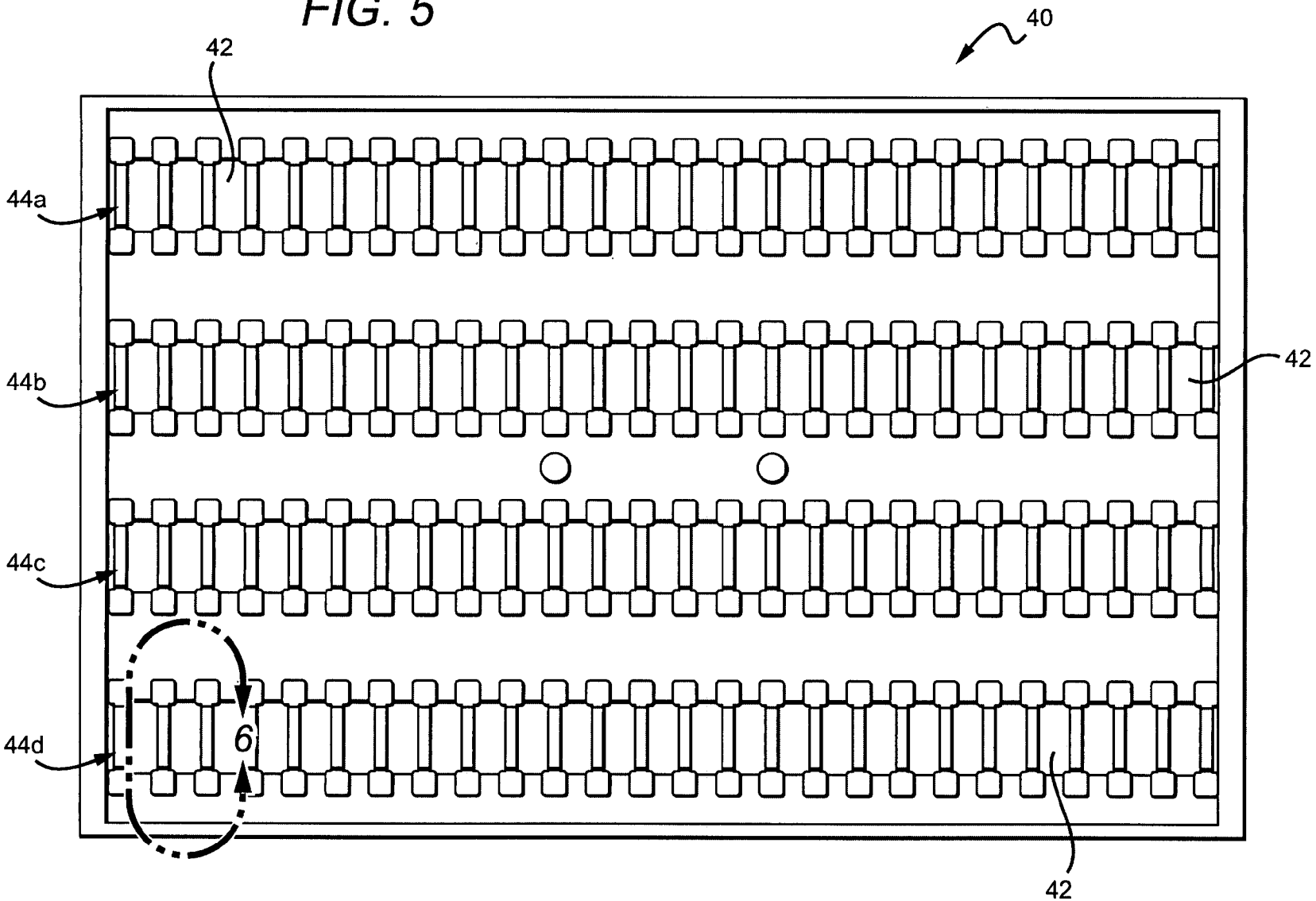
FIG. 5 is a plan view of another embodiment of a lighting module package according to the present invention for holding shorter modules.

FIG. 5 shows another embodiment of a package 40 according to the present invention arranged to hold LED modules that are smaller than the modules to be held by package 10 shown in FIG. 1. The package 40 is also sized the same as package 10 having substantially the same length and width, and comprises a plurality of cradles 42 to hold LED modules having substantially the same length. As with package 10, package 10 is 20 inches by 12 inches and is ¾ inch high, and is arranged to hold a 25 foot length of interconnected modules.

The package 40 holds smaller LED modules, so its length of modules and interconnecting wires will have a greater number of modules. As a result, the package 40 has a greater number of smaller cradles compared to package 10. The cradles 42 can be arranged in many different ways, with the cradles 42 in package 40 arranged in four cradle rows 44*a-d*. The modules are mounted in the cradles 42 with interconnecting wires preferably routed between adjacent modules.

Figure 7:
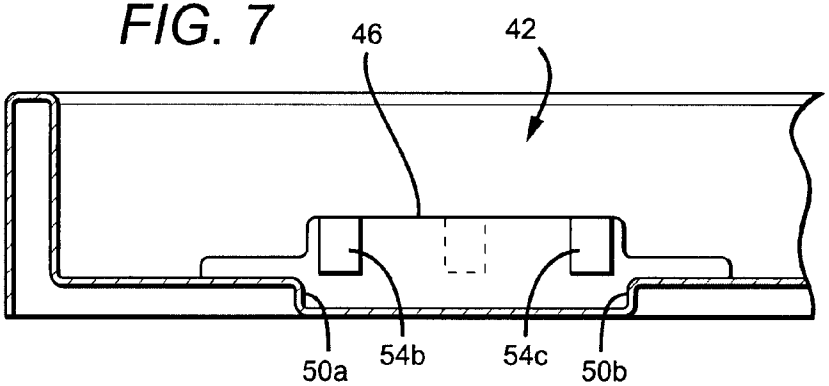
FIG. 7 is a sectional view of the cradle shown in FIG. 5.
Figure 8:
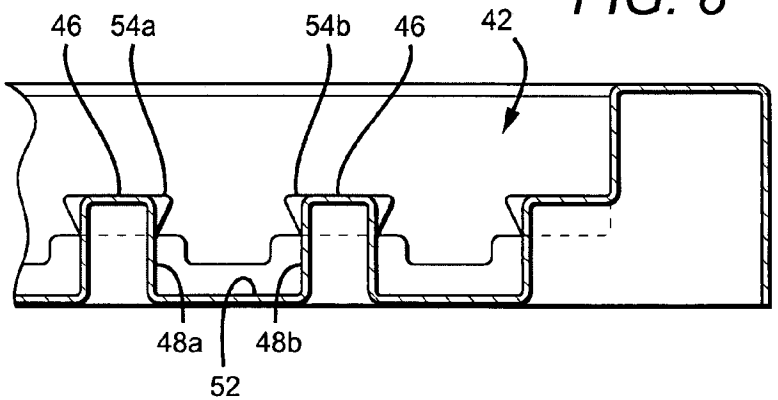
FIG. 8 is a another sectional view of the lighting module cradle shown in FIG. 5.
Figure 6:
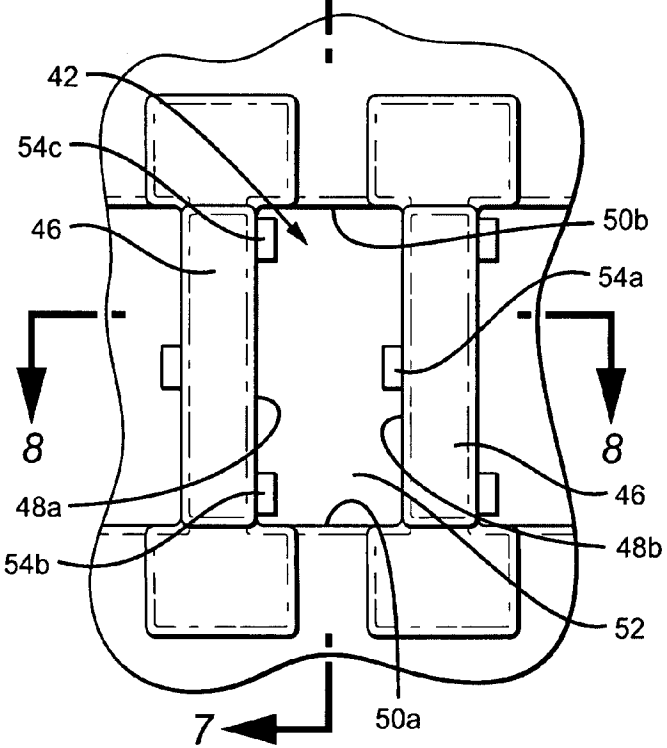
FIG. 6 is a plan view of one of the lighting module cradles in the package in FIG. 5.

FIGS. 6-8 show cradle 42 in more detail, and similar to cradles 12 above, walls 46 are provided between adjacent cradles 42 with the walls 46 providing first and second opposing side vertical surfaces 48*a*, 48*b* for each cradle 42. The cradle also comprises lower opposing end surfaces 50*a*, 50*b* and a bottom surface 52. Each of the cradles also has tabs 54*a-c* that are arranged similar to tabs 26*a-c* and hold the particular module within its cradle 42 in the same manner.

Figure 9:
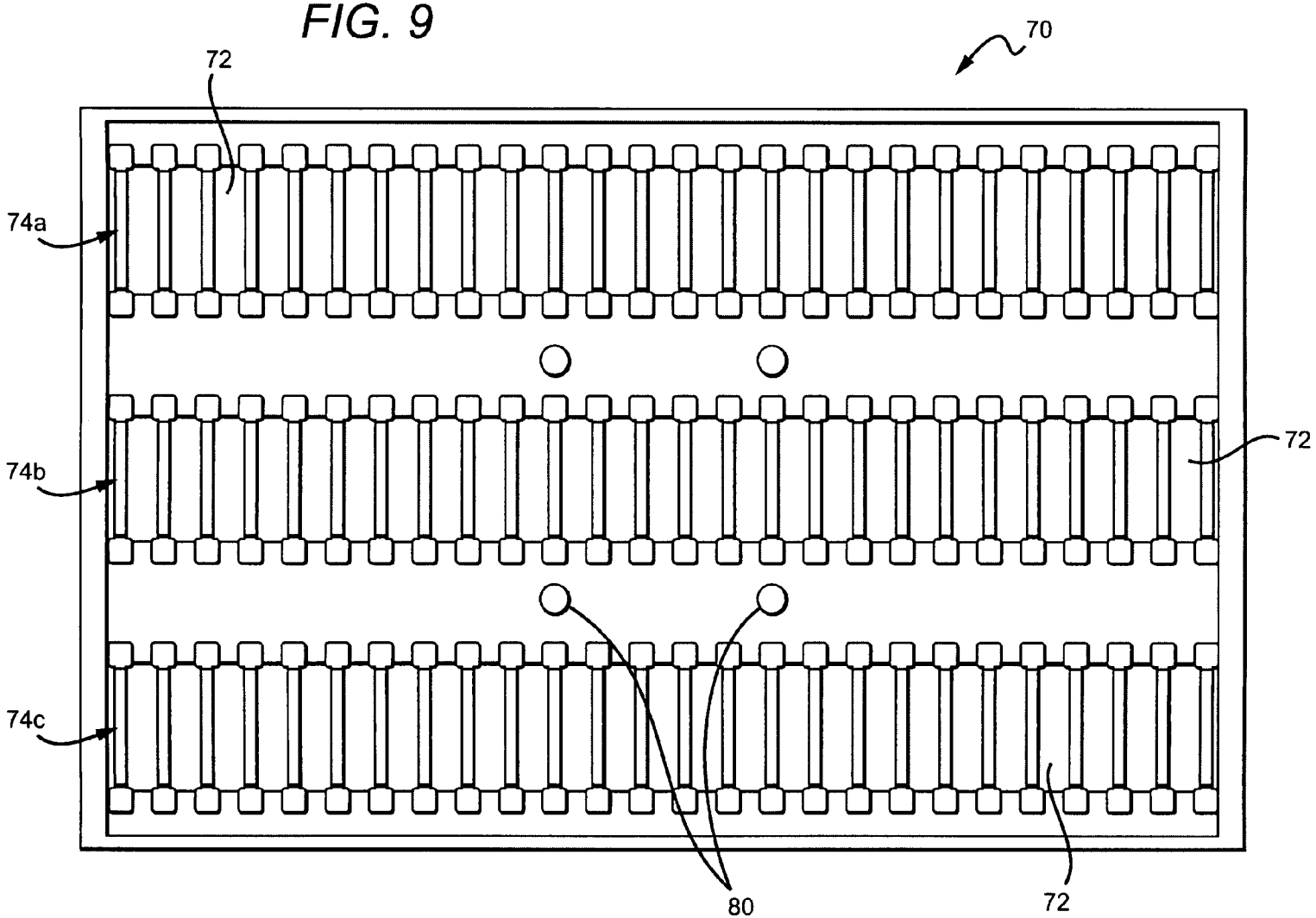
FIG. 9 is a plan view of still another embodiment of a lighting module package according to the present invention for holding longer modules.

FIG. 9 shows another embodiment of a package 70 having substantially the same size as the packages 10 and 40 above, and having a plurality of cradles 72 similar to the cradles 12 and 42 above. The cradles 72 are arranged in three (3) rows 74*a-c* and each of the cradles can hold an LED module with interconnecting wires routed between adjacent modules. The package 70 is also arranged to hold a predetermined length of modules and interconnects, with the predetermined length being 25 feet. Each of the cradles 72 also have tabs (not shown) to hold the modules in their respective cradles as described above. In other packages the cradles can be arranged without tabs as further discussed below.

Figure 10:
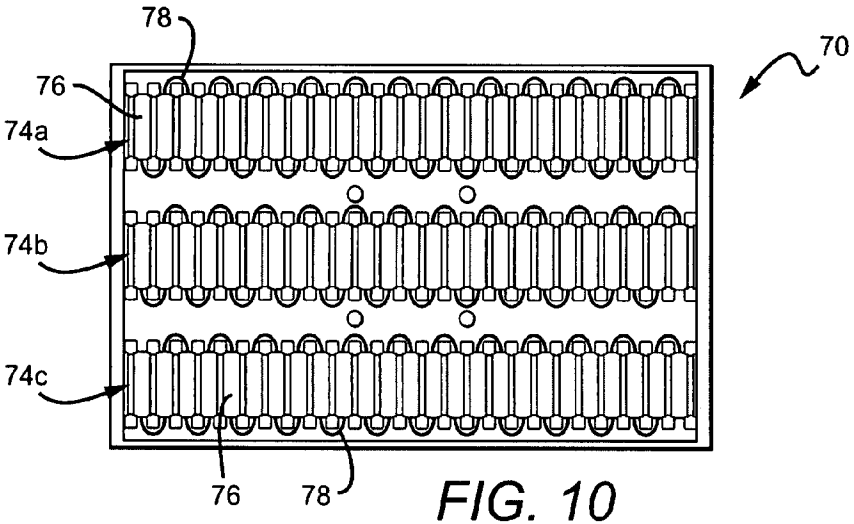
FIG. 10 is a plan view of the lighting module package of FIG. 14 holding lighting modules interconnecting wires.

FIG. 10 shows the package 70 with a length of LED modules 76 and interconnecting wire 78 mounted within the package 70. Each of the modules 76 is mounted in a respective one of the cradles as described above and is held in its cradle by cradle tabs. The interconnecting wire runs between adjacent modules in the space between adjacent ones of the rows 74*a-c*. The modules 76 and interconnecting wires are visible and accessible for inspection and testing. For example, and electrical signal can be applied to the input and of the interconnecting wires to illuminate the LED modules. This allows for quick and easy inspection of the modules to determine if any are defective and not emitting light. The interconnecting wires are easily accessible and can be cut between adjacent modules while the modules remain in their cradles. By knowing the length of interconnected modules held in the package, the desired length can be cut without removing the LED modules from the package. The desired length can then be removed from the package without disturbing the remaining modules that can be left in the package 70 for future use.

Referring again to FIG. 9, the package 70 further comprises a posts 80 located near the center of the package 70. The preferred posts 80 have a height approximately equal to the height of the package 70 and provide support for a cover placed over the package. The posts 80 help prevent flexing of the cover toward the LED modules (not shown). It is understood that different numbers of posts 80 can be included in different locations according to the present invention.

Figure 11:
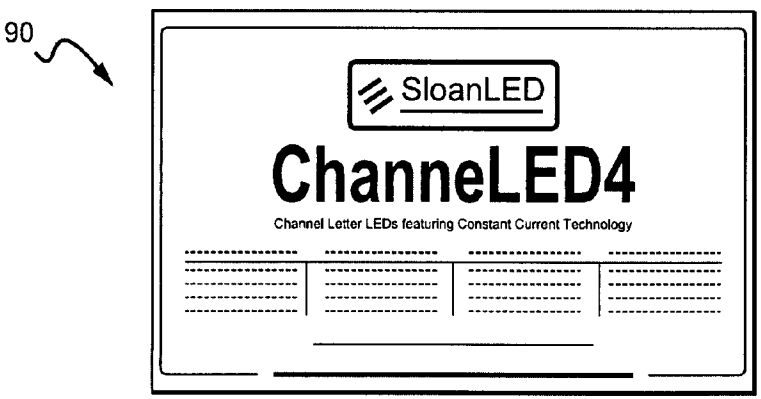
FIG. 11 is a plan view of one embodiment of a package cover according to the present invention.

FIG. 11 shows one embodiment of a cover 90 according to the present invention sized to fit over the package 70. The cover can be made of many different materials, but is preferably made of cardboard. As shown, the cover 90 can contain written information such as the company name, product name and specifications, installation instructions, etc. The cover protects the LED modules 76 and 80 particularly when the package 70 is stacked for shipping. It is understood that the cover can also be made of other materials such as plastics, and in one embodiment the cover can be at least partially transparent so that the modules are visible with the cover in place.

Figure 12:
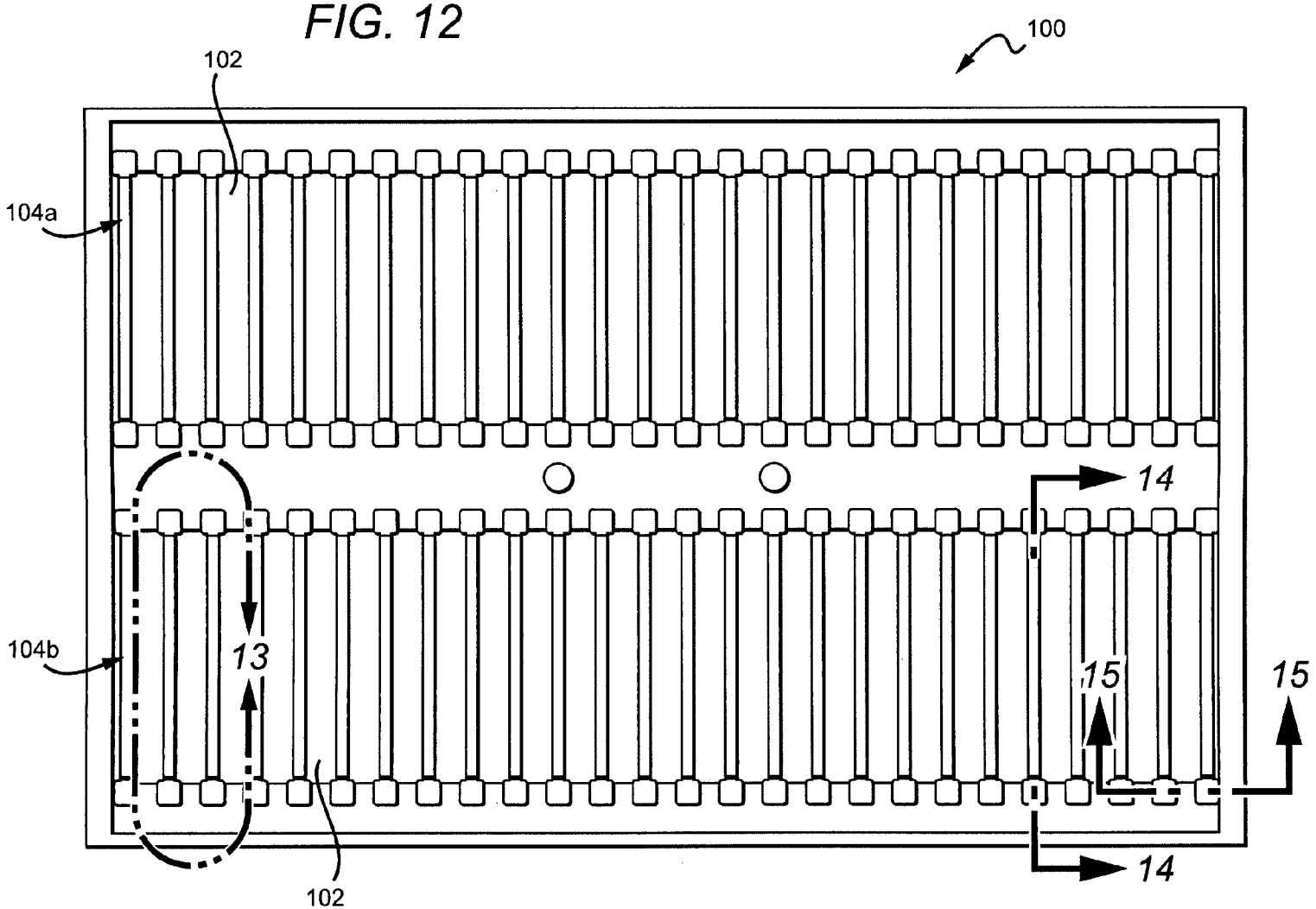
FIG. 12 is a plan view of another embodiment of a lighting module package according to the present invention for holding longer modules.

FIG. 12 shows another embodiment of a package 100 according to the present invention that has the same size as the packages above and is arranged to hold the same length of LED modules and interconnects (25 feet). The package 10 has cradles 102 arranged in two rows 104*a*, 104*b*.

Figure 13:
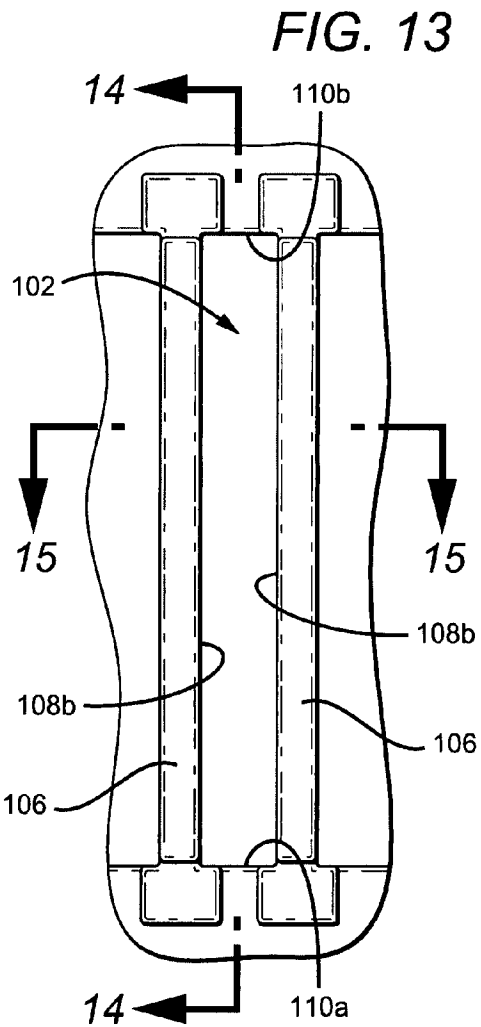
FIG. 13 is a plan view of one of the lighting module cradles in the package in FIG. 12.
Figure 15:
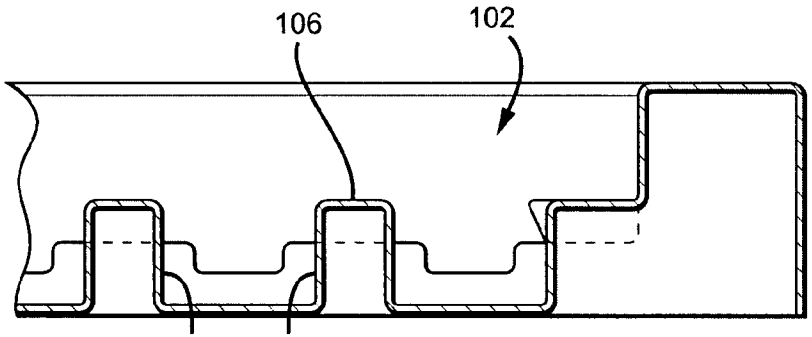
FIG. 15 is a another sectional view of the lighting module cradle shown in FIG. 12.
Figure 14:
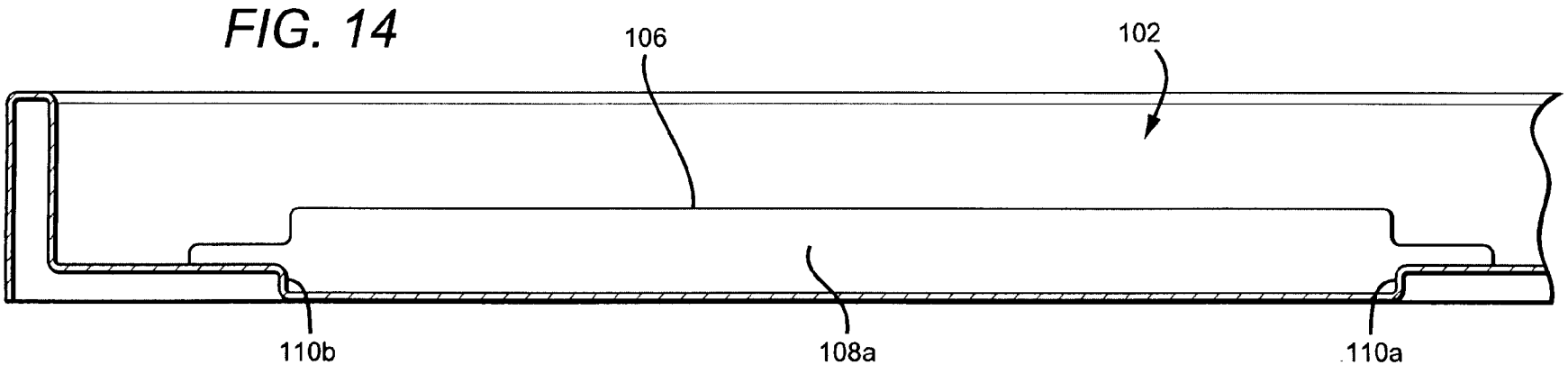
FIG. 14 is a sectional view of the cradle shown in FIG. 12.

FIGS. 13-15 show one of the cradles 102 in more detail. As with the cradles above, walls 106 are provided between adjacent cradles 102 to form opposing vertical surfaces 108*a*, 108*b*. The cradles 102 also have lower end surfaces 110*a*, 110*b*. Unlike the cradles above, however, the cradles 102 do not have tabs to hold the modules. Instead, the cradles 102 rely on the closing force of walls 106 to hold the LED modules within the cradles. When an LED module is placed in a cradle 102, the module is sized to cause flexing or compression of the wall 106. The force in opposition to this flexing or compression is sufficient to hold the module within its cradle 102. It is understood that the modules can be held in the cradles using many different mechanisms and arrangements according to the present invention.

Although the present invention has been described in detail with reference to certain preferred configurations thereof, other versions are possible. Therefore, the spirit and scope of the invention should not be limited to the versions described above.

We claim:

1. A package for holding a plurality of interconnected modules, comprising: a plurality of cradles each of which is sized to hold a respective one of a plurality of removable interconnected modules, said cradles arranged adjacent to one another with a wall between adjacent ones of said plurality of cradles, each cradle comprising first and second opposing side vertical surfaces, lower opposing end surfaces, and a bottom surface, said surfaces at least partially defining a module holding space; and a plurality of holding tabs at least one of which is on a respective one of said cradles on one of said first and second opposing side vertical surfaces and protruding into said module holding space, said tab arranged to hold its respective one of said modules in said cradle.

2. The package of claim 1, wherein each of said first and second opposing side vertical surfaces has at least one of said plurality of holding tabs.

3. The package of claim 1, wherein said cradles are adjacent to one another in a substantially flat orientation.

4. The package of claim 1, wherein said cradles are arranged in a plurality of rows.

5. The package of claim 1, made of a resilient material.

6. The package of claim 1, wherein said first and second opposing side vertical surfaces are made of a resilient material.

7. The package of claim 1, further comprising a cover over said cradles.

8. The package of claim 7, further comprising posts to hold said cover over said cradles without interfering with said cradles.

9. The package of claim 7, wherein said cover further comprises written information.

10. The package of claim 1, wherein said modules comprise LED modules.

11. A package holding a plurality of LED modules, comprising: a plurality of LED modules interconnected by wire; a plurality of cradles each of which is sized to hold a respective one of said plurality of interconnected LED modules, each of said cradles comprising first and second opposing side vertical surfaces, lower opposing end surfaces, and a bottom surface, said surfaces at least partially defining a module holding space for holding its respective one of said LED modules, each of said LED modules arranged in a respective one of said cradles; a plurality of holding tabs at least one of which is on one of said first and second opposing side vertical surfaces of each of said cradles and protruding into said module holding space, each of said tabs arranged to hold its respective one of said modules in its one of said cradles, wherein said cradles are arranged adjacent to one another with said interconnecting wire running between adjacent cradles; wherein said modules are removable from said cradles.

12. The package of claim 11, wherein each of said cradles further comprising a plurality of holding tabs, each of which is on one of said first and second opposing side vertical surfaces and protrudes into said module holding space.

13. The package of claim 11, wherein said first opposing side vertical surface has a different number of tabs than said second opposing side vertical surface.

14. The package of claim 11, wherein at least some of said cradles are adjacent to one another in rows in a substantially flat orientation.

15. The package of claim 11, made of a resilient material.

16. The package of claim 11, further comprising a cover over said cradles.

17. The package of claim 15, further comprising posts to hold said cover over said cradles without interfering with said cradles.

18. The package of claim 17, being stackable on others of said packages.

19. The package of claim 11, wherein said LED modules comprise LEDs that are visible for inspection when said modules are arranged in its respective one of said cradles.

20. The package of claim 19, wherein said LED modules can be illuminated while said modules are in said cradles.

21. The package of claim 11, wherein said interconnecting wires are accessible for cutting when said LED modules are mounted in said cradles.

22. A package for holding a plurality of interconnected modules, comprising: a plurality of walls, the surfaces of said walls comprising first and second opposing side vertical surfaces, lower opposing end surfaces, and a bottom surface, respective ones of said opposing side vertical surfaces at least partially defining one of a plurality of module holding cradles, with each of said cradles sized to hold a respective one of a plurality of interconnected modules, said cradles arranged immediately adjacent to one another and separated by one of said plurality of walls with each of said cradles first and second opposing side vertical surfaces partially defining the module holding space, wherein said walls are made of a resilient material such that said first and second opposing side vertical surfaces of each of said cradles provides an opposing holding force.

* * * * *